United States Patent [19]

LaPointe

[11] Patent Number: 4,613,186

[45] Date of Patent: Sep. 23, 1986

[54] CHAIR WITH LATCH MECHANISM

[75] Inventor: Larry P. LaPointe, LaSalle, Mich.

[73] Assignee: La-Z-Boy Chair Company, Monroe, Mich.

[21] Appl. No.: 673,877

[22] Filed: Nov. 21, 1984

[51] Int. Cl.[4] ..... A47C 1/02

[52] U.S. Cl. ..... 297/83; 297/259; 297/341

[58] Field of Search ..... 297/83, 259, 341, 330; 248/393, 429

[56] References Cited

U.S. PATENT DOCUMENTS

| | | | |
|---|---|---|---|
| 3,588,170 | 6/1971 | Knabush et al. | 297/330 |
| 4,101,169 | 7/1978 | Muraishi et al. | 297/341 |
| 4,159,147 | 6/1979 | Kiyomitsu et al. | 297/341 |
| 4,179,157 | 12/1979 | Shoemaker et al. | 297/259 |
| 4,506,926 | 3/1985 | Griggs, Jr. | 297/83 |

FOREIGN PATENT DOCUMENTS

| | | | |
|---|---|---|---|
| 2443514 | 3/1976 | Fed. Rep. of Germany | 297/341 |

*Primary Examiner*—James T. McCall

*Attorney, Agent, or Firm*—Harness, Dickey & Pierce

[57] ABSTRACT

A reclinable back rocking chair includes a subframe mounted for longitudinal fore and aft movement on a stationary base and has anti-rocking means actuated when a leg rest is elevated and when the subframe is not in its forwardmost position as well as a novel latch mechanism for automatically latching the subframe in its forwardmost and rearmost positions and manual means for unlatching the latch mechanism to permit fore and aft movement.

6 Claims, 5 Drawing Figures

CHAIR WITH LATCH MECHANISM

BRIEF SUMMARY OF THE INVENTION

This invention relates to chairs and particularly to upholstered chairs that are used as furnishings for the home. The invention is especially useful with chairs that have reclinable backs and even more so if the chairs are also rockers. U.S. Pat. No. 4,179,157, issued Dec. 18, 1979, shows a chair similar to that of this invention and is the most relevant prior art of which applicant is aware.

Reclinable back chairs often contain mechanism that moves or permits motion of the chair body forwardly on a fixed base during back recline. This is to compensate for rearward movement during recline and thereby avoid contact of the reclining back with a wall, etc. It is the purpose of this invention to provide a mechanism to automatically latch the chair body to the base in its forwardmost and rearmost positions and which includes conveniently operated means for manually unlatching the chair body from either of the latched positions. The latch mechanism of this invention is different in construction and operation from that which is shown in the aforementioned U.S. Pat. No. 4,179,157.

In a preferred embodiment of the invention, the fixed base has ratchet-toothed brackets located to define the desired forwardmost and rearmost positions for the chair body, the forwardmost being a position in which the fully reclined back does not contact an adjacent wall and the rearmost being a position in which the chair body is centered over the base. The chair body, by way of a supporting subframe or carriage that is longitudinally movable on the base, carries a pivotal latch pawl which is spring biased into latching engagement with one or the other of the two ratchet brackets. A finger-operated mechanical switch is mounted on the chair body adjacent an arm rest and controls movement of a Bowden wire that is connected to the latch pawl to pivot it against spring pressure so that unlatches from the ratchet brackets to permit the chair body to be moved longitudinally on the base.

DESCRIPTION OF THE DRAWINGS

FIG. 3 is a plan view and cross section of the structure of FIG. 2 but showing only the right hand side of the chair;

DESCRIPTION OF THE INVENTION

Figure 2:
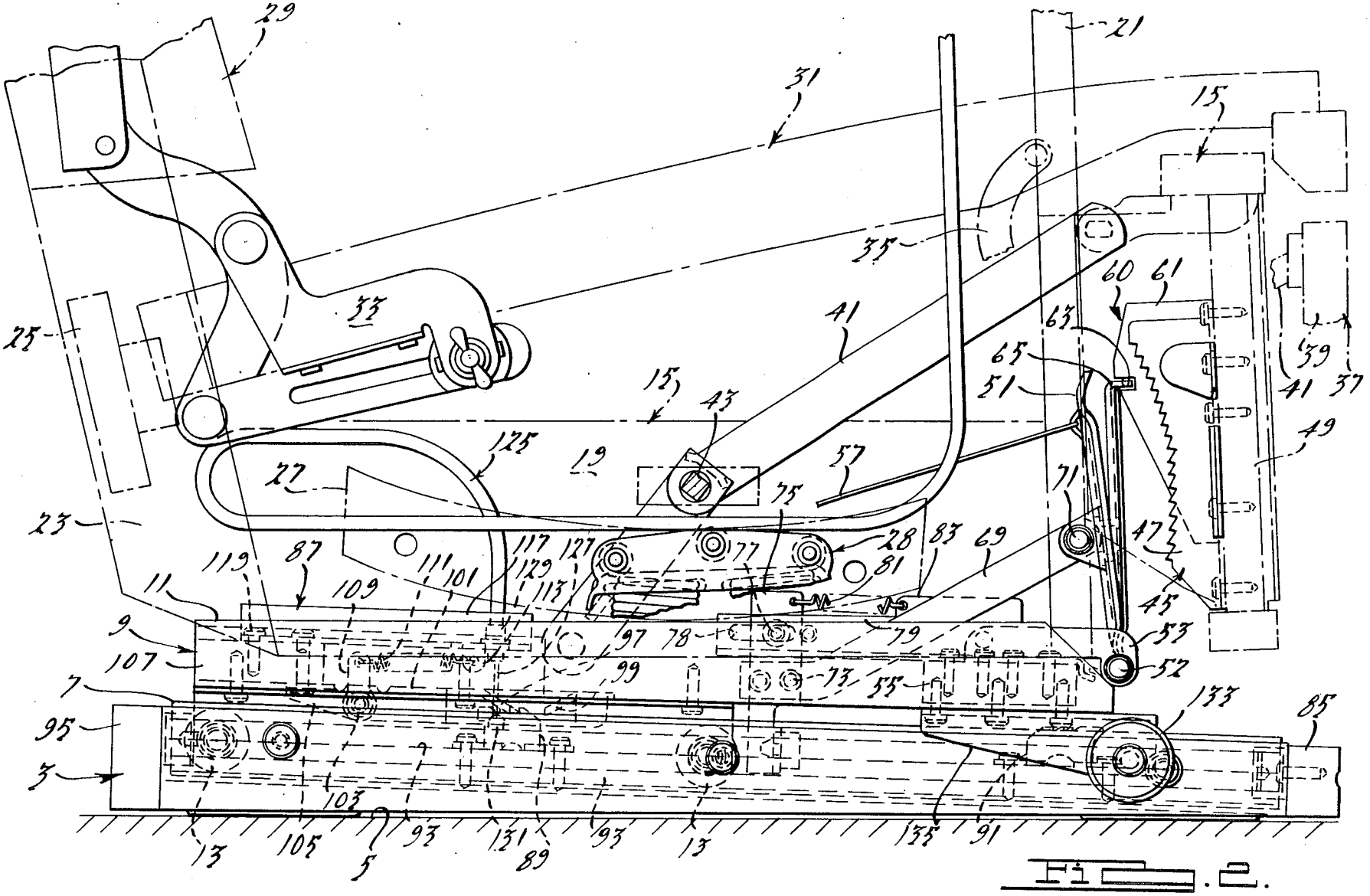
FIG. 2 is a vertical cross section, enlarged, with upholstery and parts removed or broken away, of the chair of FIG. 1, embodying the invention.
Figure 2:
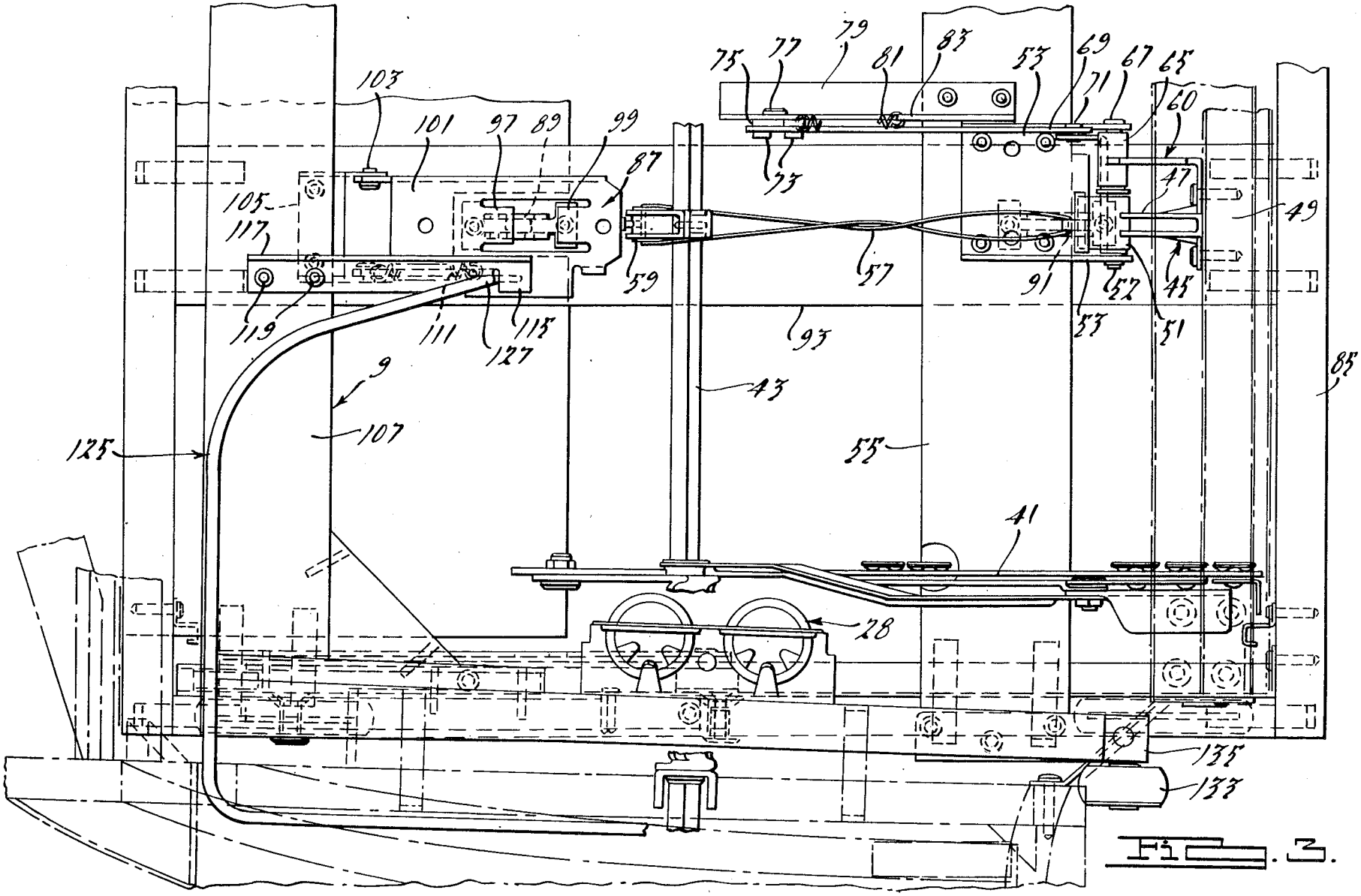

The chair 1 shown as a preferred embodiment of the invention includes a wooden, rectangular, stationary base frame structure 3 which sits on the surface 5 of a floor or the like and is slightly tapered so that it is higher at the rear than at the front of the chair. Mounted on the inside faces of the left and right hand longitudinal sides of frame 3 are metal channel shaped tracks 7 (FIG. 2) which slant downwardly so that their rear ends are higher than their front ends.

The chair 1 also includes a wooden, rectangular, movable subframe or carriage structure 9 which is mounted on the base frame 3 to move longitudinally back and forth on it. The subframe 9 is slightly tapered in a reverse manner to base frame 3 (i.e., it is higher at the front than the rear) so that the top surface 11 presented by the subframe 9 is horizontal and substantially parallel to floor surface 5. Each longitudinal side of the subframe 9 has a bracket affixed to its inside face which carries a pair of longitudinally spaced wheels 13 that ride inside the respective channel-shaped tracks 7 on the base frame 3 and provide for relatively friction free longitudinal, back and forth movement of the subframe. It is the purpose of this invention to provide structure (to be described hereinafter) for automatically latching and manually unlatching the subframe 9 in its extreme positions at the front and rear of the base frame 3.

The chair 1 has a chair frame 15 that includes left and right hand sides, each with an arm rest 17 at the top and a relatively deep longitudinal frame member 19 at the bottom as well as vertically extending frame post 23 at the rear. Appropriate cross frame structure, including rear cross piece 25, solidly unite opposite sides of the chair frame 15.

The chair frame 15 is rockably mounted in a platform rocker manner on the subframe 9 by curved rocker blocks 27 which are affixed to the insides of frame members 19 and have arcuate rocker faces that engage and rock upon the flat top surface 11 of the subframe. A double coil spring mechanism 28 of known construction is affixed to each rocker block 27 and to the adjacent side of the subframe 9 to securely interconnect the chair frame 15 and subframe and to provide spring resistance to rocking backward or forward from a centered position.

The chair frame 15 pivotally and removably carries a reclinable back frame assembly 29, such as that described in U.S. Pat. No. 3,525,549 issued Aug. 25, 1970 and shown partially in aforementioned U.S. Pat. No. 4,179,157 issued Dec. 18, 1979. The back 29 is reclined when the occupant of the chair leans backwardly against it and it returns to upright position when pressure is removed due to arrangement of the supporting linkage.

A seat frame assembly 31 is positioned between opposite sides of the chair body 15 and is pivotally suspended at its rear from the back frame assembly 29 by linkage means 33. It is pivotally mounted at its front on the chair frame 15 by means of linkage 35. More details of this type of seat frame assembly mounting (and interconnection with the back frame) are shown in U.S. Pat. No. 4,367,895, issued Jan. 11, 1983, and in the patents referred to therein.

A movable leg rest assembly 37 is mounted at the front of the chair frame 15 below the seat frame 31. It includes a leg rest frame board 39 that can be manually operated by linkage 41, actuated by cross shaft 43, to move from an inoperative vertical position at the front of the chair body to an extended substantially horizontal position in which it is operative as a leg rest. More details of this feature are shown in the aforementioned U.S. Pat. No. 4,367,895.

A first anti-rocker mechanism 45 is provided to prevent rocking of the chair frame 15 on the subframe 9 if the footrest 37 is extended more than a predetermined amount, preferably about 10° to 15° from the vertical position. This mechanism is described in more detail in U.S. Pat. Nos. 4,154,475 issued May 15, 1979 and 4,179,157 issued Dec. 18, 1979. It includes a U-shaped toothed ratchet-like bracket 47 that is affixed to a vertical section 49 of the chair frame 15. It also includes a vertically extending pawl 51 that is pivoted at its bottom end 52 to support bracket 53 which is secured on a cross piece 55 at the front of the subframe 9. Since the chair frame 15 and subframe 9 are fixed in longitudinal position relative to each other by spring means 28, so are pivot 52 and bracket 47. The top end of pawl 51, however, is connected by stiff spring wire means 57 to the bottom of a lever 59 (FIG. 3) which is mounted on and turns with the foot rest operating shaft 43, the lever 59 extending downwardly from shaft 43. When the side handle 43A (FIG. 1) is moved by a chair occupant to extend the foot rest assembly 37, it rotates shaft 43 in a counterclockwise direction, so that the spring wire 57 moves forward to force the pawl 51 into one of the teeth on the bracket 47, the precise tooth depending on the rocking angle at that moment of the chair frame 15 relative to the subframe 9. Conversely, when the footrest 37 is lowered, the spring wire means 57 removes the pawl 51 from the bracket 47 so that anti-rocker mechanism 45 becomes inoperative.

A second anti-rocker mechanism 60 is provided to prevent rocking of the chair frame 15 on the subframe 9 unless the subframe is all the way to front with respect to its longitudinal movement on the base frame 3. This mechanism is described in more detail in the aforementioned U.S. Pat. No. 4,179,157. It includes an angle-shaped bracket 61, having slot 63, that is affixed to vertical section 49 of the chair frame 51. It also includes a vertically extending pawl 65 that is pivoted at its bottom end at 67 to the support bracket 53 which is a part of subframe 9. An actuator link 69 has its front and upper end pivoted at 71 to the pawl 65 and its rear end lower end fixed at 73 to the bottom of movable vertical bar 75. The bar 75 has a centrally located cross pin 77 which rides in a longitudinal slot 78 in the rear end of longitudinal bracket 79 and secures it to the bracket, the front of the bracket 79 being affixed to subframe cross piece 55. A coil spring 81 extends in tension between the vertical bar 75 and an ear 83 of the bracket 79 to yieldably urge the bar 75 and therefore the link 69 and pawl 65 to their most forward positions; i.e., urging the pawl 65 to slip into slot 63 where it will prevent rocking of the chair frame on the subframe. The vertical bar 75, however, is located on the subframe in a position such that it engages the rear face of the front cross bar 85 of the base frame 3 just as the subframe reaches the most forward or extreme front position. This engagement holds the bar 75 (and connected link 69 and pawl 65) in stationary position as the subframe continues to move forward, the bar cross pin 77 sliding in slot 78 of bracket 79, to carry the slot 63 and bracket 61 off of the pawl 65. This permits the chair frame to rock, providing that the leg rest 37 hasn't been extended to the degree required to actuate the first anti-rocker mechanism 45.

Figure 1:
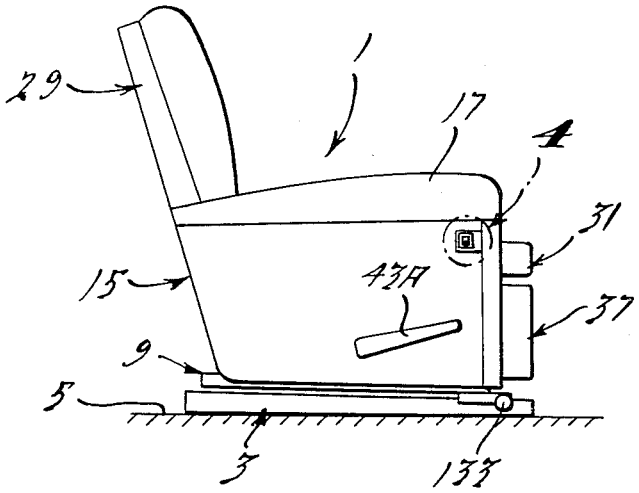
FIG. 1 is a schematic side elevation of an upholstered chair embodying the invention shown in the upright and rearmost position in which the chair body is centered on the base.

The chair 1 also includes latch mechanism 87 to automatically latch the subframe 9 (and thus the chair frame 15 and the parts it carries) to the base assembly against longitudinal movement in both its forwardmost position (wherein anti-rocker mechanism 60 is deactivated as just described) and in its rearmost position, the means 87 including manually operated unlatching means for releasing the subframe with chair body 15 so that they can move forwardly down the inclined tracks 7 due to the effect of gravity and weight of a chair occupant or so that it can be moved to its rearmost, normal, chair-unoccupied position of FIG. 1. The latch means 87 described herein is different from the mechanisms shown in U.S. Pat. 4,179,157 for holding the chair in these positions, as will become apparent.

The latch mechanism 87 includes a two-sided ratchet toothed rear bracket 89 and a two-sided ratchet toothed front bracket 91, each bracket being of sturdy metal construction and located in the midplane of the chair. They are affixed to a longitudinally extending central member 93 of the base frame 3 which is rigidly secured to the front crosspiece 85 and to a rear crosspice 95 of the base frame 3. The member 93 is higher at the rear than at the front so that it is on the same incline as the tracks 7. The rear bracket 89 serves as means to lock the subframe 9 in a rearmost position and the vertical faces of its ratchet teeth face the rear of the chair. The front bracket 91 serves as means to lock the subframe 9 in a most forward position and the vertical faces of its ratchet teeth face the front of the chair.

Acting with the teeth on the brackets 89 and 91 are downwardly inclined tabs or tongues 97 and 99 formed in the web of a sturdy U-shaped metal pawl 101 which is located in the midplane of the chair. The two sides of the pawl, at their rear ends, fit with and are pivoted at 103 to the front ends of the two sides of a sturdy metal U-shaped bracket 105 which has a web affixed to the bottom of rear cross piece 107 of the subframe 9. The rear tab 97 extends forwardly and down and is adapted to engage any transversely aligned pair of rearwardly facing vertical tooth faces found on the two side edges of the rear bracket 89 to hold the subframe in the rear position. The front tab extends rearwardly and down and is adapted to engage any transversely aligned pair of the forwardly facing vertical tooth faces formed on the two side edges of the front bracket 91 to hold the subframe in the front position.

The pawl 101 is spring biased to force the tabs 97 and 99 downwardly. For this purpose the rear of one of the sides of the pawl 101 has an upstanding lug section 109 to serve as an anchor for the rear end of coil tension spring 111. The front end of spring 111 is anchored to a downwardly extending lug section 113 formed from the otherwise horizontal side 115 of an angle-shaped metal bracket 117 which is fixed at its rear end 119 to the top of subframe crosspiece 107. Tension in spring 111 as well as gravity urges the pawl 101 to turn in a clockwise direction about its pivot 103 and this biases the tabs 97 and 99 downwardly to latching positions.

Figure 4:
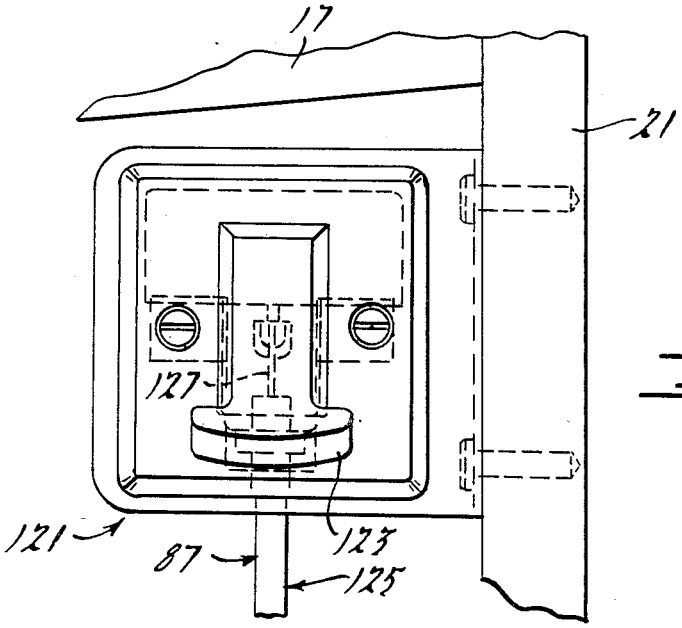
FIG. 4 is an enlarged view but with upholstery removed of the mechanical switch arrangement as shown in the circle 4 of FIG. 1, FIG. 4 also being an enlarged extension of the top right portion of FIG. 2.
Figure 5:
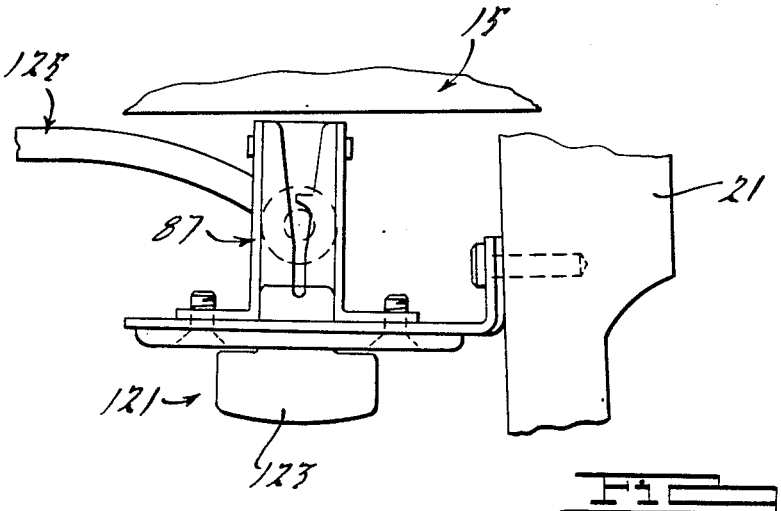
FIG. 5 is a plan view of the structure of FIG. 4 and also being an extension on an enlarged scale of structure at the right, bottom corner of FIG. 3.

The tabs 97 and 99 are lifted from latched positions by a manual actuator means 121 including a finger operated mechanical switch mechanism 123 located on a side of the chair frame 15 (FIGS. 1 and 4) adjacent the front of an arm rest 17. Actuation of switch 123 pulls the wire 127 in a laterally flexible Bowden wire mechanism 125, the case of which is supported at its end 129 on side 115 of bracket 117 and the wire 127 of which extends downwardly through an opening in the pawl 101 and has an enlarged head 131 below the web of the pawl. When the switch 123 is actuated the head 131 is raised whereby it engages the pawl 101 to pivot it counterclockwise about pivot 103 and lift tab 97 or 99 out of ratchet bracket 89 or 91, respectively. The subframe 9 is then free to move longitudinally on the base frame 3. When it is moved to the most forward position, wheels 133 carried by brackets 135 on subframe 9 will roll on floor surface 5 to furnish support for the subframe when it extends well beyond the front rail 85 of the base 3. In the most forward position, the chair can be rocked as described above. In any position the back 29 can be reclined, as shown in more detail in the patents referred to above. However, in the most forward position, the recline will not bring the chair envelope any closer to a wall (not shown) behind the chair since the subframe and back 29 will have moved forward by an amount which compensates for maximum rearward movement of the back during recline.

Operation of the structure shown has been described above. The latch mechanism 87 is located and constructed to be sturdy, strong and durable and capable of withstanding repeated loads that may be applied to it when the chair is in a latched position and of smoothly and quietly operating to permit automatic latching.

Modifications in the specific structure shown may be made without departing from the spirit and scope of the invention.

I claim:

1. In a chair, a stationary base frame, a second frame mounted on the base frame for longitudinal fore and aft movement between a forwardmost position and a rearmost position, a chair body having sides and carried by said second frame to move longitudinally with it, a forward toothed latch bracket, a rear toothed latch bracket, said brackets being mounted on said base frame and located to determine respectively said forwardmost and rearmost positions, a movable pawl pivotally mounted on the second of said frames on a horizontal axis and yieldably biased by gravity to operatively engage the teeth in said brackets, and manual means for moving the pawl to disengage it from said brackets, said manual means including a mechanical actuator switch mounted on said body adjacent the top of one of said sides and operable to actuate the pawl.

2. A chair as set forth in claim 1 including a support bracket and having a wire operatively connected to said pawl to move it and spring means between the support bracket and pawl to yieldably urge and bias the pawl into latching position to operatively engage the teeth in said brackets.

3. In a chair, a stationary base frame, a second frame mounted on the base frame for longitudinal fore and aft movement between a forwardmost position and a rearmost position, a forward toothed latch bracket, a rear toothed latch bracket, said brackets being mounted on one of said frames and located to determine respectively said forwardmost and rearmost positions, a movable pawl mounted on the other of said frames and yieldably biased to operatively engage the teeth in said brackets, manual means for moving the pawl to disengage it from said brackets, a chair body having sides and carried by said second frame, said manual means including a mechanical actuator switch mounted on said body adjacent the top of one of said sides and operable to actuate the pawl, said brackets being mounted on said base frame and said pawl being pivotally mounted on said second frame, a support bracket mounted on said second frame and located above said pawl, said manual means including a Bowden wire assembly based on said support bracket and having a wire operatively connected to said pawl to move it, spring means between the bracket and pawl to yieldably urge the pawl into latching position, said chair body carried on said second frame moving longitudinally with it and having arm rest portions, and a mechanical switch mounted on said chair body adjacent an arm rest and operatively connected to said Bowden wire assembly to activate it to move said pawl.

4. A chair as set forth in claim 3 wherein said second frame includes a cross piece at the rear thereof, said support bracket being secured at its rear end to the top of said cross piece, a pawl pivot bracket secured at its rear to the bottom of said cross piece, said pawl being pivoted at its rear to said pawl pivot bracket.

5. A chair as set forth in claim 4 wherein said ratchet brackets and said pawl are located substantially on a midline of the chair.

6. A chair as set forth in claim 5 wherein said chair body has a reclinable back and an extensible leg rest and is rockably mounted on said second frame, and including anti-rocker means operative to prevent rocking unless the second frame is in its forwardmost position and the leg rest is unextended.

* * * * *